United States Patent [19]

Kabashima

[11] 4,190,126

[45] Feb. 26, 1980

[54] ROTARY ABRASIVE DRILLING BIT

[75] Inventor: Ryuichi Kabashima, Yokohama, Japan

[73] Assignee: Tokiwa Industrial Co., Ltd., Tokyo, Japan

[21] Appl. No.: 862,393

[22] Filed: Dec. 20, 1977

[30] Foreign Application Priority Data

Dec. 28, 1976 [JP] Japan ..... 51-159141

[51] Int. Cl.[2] ..... E21B 9/16

[52] U.S. Cl. ..... 175/410; 175/330; 175/379; 175/412

[58] Field of Search ..... 175/410, 412, 329, 330, 175/379; 76/108 A, 108 R; 51/309 R

[56] References Cited

U.S. PATENT DOCUMENTS

| | | | |
|---|---|---|---|
| 2,147,843 | 2/1939 | Jamar et al. | 76/108 R |
| 2,234,273 | 3/1941 | Pennington | 175/379 X |
| 3,106,973 | 10/1963 | Christensen | 175/410 X |
| 3,546,150 | 10/1970 | Stebley | 175/412 X |
| 3,726,351 | 4/1973 | Williams, Jr. | 175/410 |
| 3,999,962 | 12/1976 | Drui et al. | 51/309 R X |
| 4,042,347 | 8/1977 | Sioui | 51/309 R X |

FOREIGN PATENT DOCUMENTS

| | | | |
|---|---|---|---|
| 2035261 | 1/1972 | Fed. Rep. of Germany | 175/410 |
| 679193 | 12/1964 | Italy | 175/330 |

*Primary Examiner*—Ernest R. Purser
*Assistant Examiner*—Nick A. Nichols, Jr.
*Attorney, Agent, or Firm*—Watts, Hoffmann, Fisher & Heinke Co.

[57] ABSTRACT

A rotary abrasive drilling bit disclosed herein is of a construction wherein teeth are equipped on the fore part of a bit body attached to a rotary drill pipe, each of said teeth is composed of a plurality of chips which are made of cemented tungstencarbide and the matrix thereof which is soft and inferior in abrasion resistance relative to said cutting elements or chips, each chip is shaped like a thin stick and extends along the cutting direction of said bit body, the matrix surrounds said chips, and in the matrix of each tooth the chips are orderly arranged to leave a desired interspace along the direction of radius as well as the direction of circumference of the bit body.

5 Claims, 10 Drawing Figures

ROTARY ABRASIVE DRILLING BIT

BACKGROUND OF THE INVENTION

The present invention relates to a rotary abrasive drilling bit for the purpose of boring the ground, which is devised to perform the drilling of the object face by constantly rubbing said face with the teeth equipped thereon.

An apparatus of this kind in the prior art, as exemplified in FIG. 1, is provided with a bit 101 which is constructed by planting a plurality of square cutting elements or chips 109 made of cemented tungstencarbide on a bit body 102 by arranging them so as to leave a desired interspace along the direction of circumference of said bit body and to let the edge of the respective chips slightly project from the top face of the bit body 102. In the case of an apparatus of such a construction, the length of a locus of the section of each chip 109 is more than about 5 millimeters and the sectional area of each chip 109 is relatively large as compared with the top face of the bit body 102, and there is admittedly caused no inconvenience in the initial stage of drilling work. However, when the edge of the respective chips 109 is worn down to become round with the progress of the drilling work, the boring efficiency lowers remarkably and at times the cutting operation comes to a halt. As a result, notwithstanding there still remains a sufficient portion of cemented tungstencarbide which constitutes the chips 109, the chips 109 must be replaced only because of abrasion of their edges. Accordingly, it has various disadvantages such that the work efficiency thereof is low and a large portion of cemented tungstencarbide is wasted without being fully utilized for the drilling.

SUMMARY OF THE INVENTION

A primary object of the present invention is to provide a rotary abrasive drilling bit which eliminates the aforementioned drawbacks of the conventional bits.

Another object of the present invention is to provide a rotary abrasive drilling bit which is of a construction wherein teeth are equipped on the fore part of a bit body attached to a rotary drill pipe, each of said teeth is composed of a plurality of cutting elements (referred to herein as "chips") which are made of cemented tungstencarbide and the matrix thereof which is soft and inferior in abrasion resistance relative to said chips, each cutting element or chip is shaped like a thin stick and extends along the cutting direction of said bit body, the matrix surrounds said chips, and in the matrix of each tooth the chips are orderly arranged to leave a desired interspace along the direction of radius as well as the direction of circumference of the bit body, whereby there can be obtained a boring speed which affords a satisfactory cutting efficiency, and this boring speed is stably maintained until the tooth is substantially consumed so that the cutting can be performed continuously.

A further object of the present invention is to provide a rotary abrasive drilling bit wherein the surface of said tooth is composed of a compound surface consisting of the top faces of said chips and the surface of said matrix, whereby the matrix properly wears down continuously at the time of the drilling work and accordingly the fine tips of the chips naturally project by a proper length continuously, thereby rendering it possible to perform the drilling of the ground, to wit, rock, soil, etc., by utilizing the superb hardness as well as abrasion resistance of these chips.

A still further object of the present invention is to provide a rotary abrasive drilling bit wherein the shape of the section of each chip is circular or similar thereto, whereby it is suited for the drilling in the case where the object ground, particularly rock, is of a relatively soft formation or a semi-hard formation.

Still another object of the present invention is to provide a rotary abrasive drilling bit wherein the shape of the section of each chip is semicircular or similar thereto and the linear portion thereof is disposed at the rear in relation to the direction of rotation of said bit body, whereby it is suited for the drilling in the case where the object ground, particularly rock, is of a relatively hard formation.

DETAILED DESCRIPTION OF THE INVENTION

Figure 1:
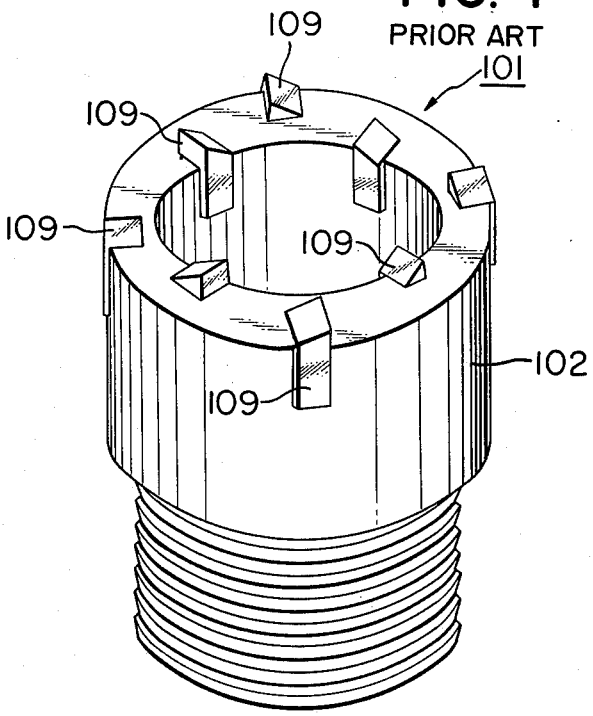
FIG. 1 PRIOR ART
FIG. 1 is a perspective view which illustrates a typical example of the conventional rotary abrasive drilling bits.
Figure 2:
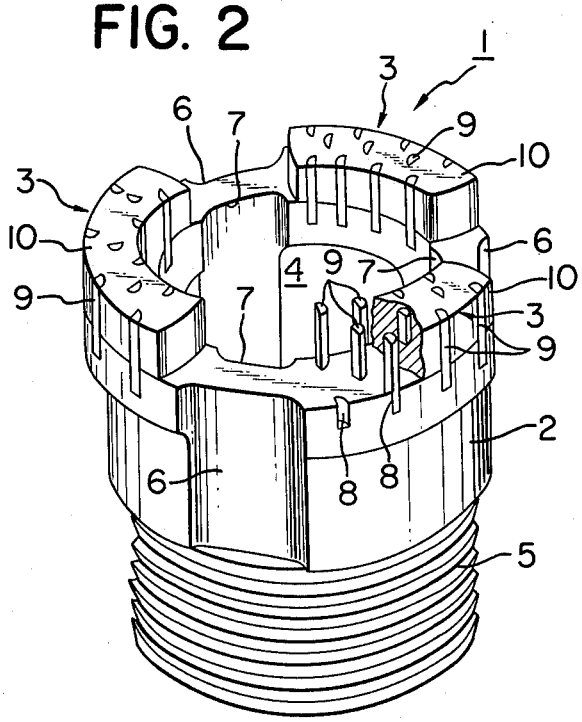
FIG. 2 is a perspective view, partially broken away, of a first embodiment of the rotary abrasive drilling bit according to the present invention, as taken from the same angle as in FIG. 1.

Shown in FIG. 2 is a first embodiment of the rotary abrasive drilling bit according to the present invention, which is of a type wherein cemented tungstencarbide cutting elements or chips are directly planted in the bit body.

The bit 1 shown in FIG. 2 is composed of a bit body 2 and teeth 3 disposed on the fore part of said bit body 2. The bit body 2 is shaped in a hollow tube having a hollow part 4 for containing cores therein. The periphery of the base of the bit body 2 is provided with a threaded portion 5 to engage with a threaded portion of a rotary drill pipe not shown herein. By virtue of engagement of the two threaded portions, the bit body 2 is fixed to the drill pipe and rotates with the drill pipe. On the outer wall of the fore part of the bit body 2 whose outside diameter is slightly larger than that of the base of the bit body 2 are formed plural grooves 6—in FIGS. 2, 3 grooves are formed—which axially extend along the bit body 2 and are disposed at equal intervals, while on the inner wall of the bit body 2 are provided grooves 7 extending from the base to the fore end of the bit body 2 which are formed in a fashion similar to the grooves 6 and disposed back to back therewith.

The top face of the bit body 2 is formed in a plane perpendicular to the axis of the bit body 2. Of this tip, the portions not provided with said grooves 6 and 7, that is, plural portions as equally divided along the direction of circumference of the bit body—in FIG. 2, three blocks—are respectively provided with a plurality of relatively shallow holes 8 which extend along the direction of axis of the bit body 2 from said plane, said holes being formed in the respective blocks in such an arrangement as exemplified in FIG. 2. That is, in FIG. 2, in each block, 4 holes are formed in the outermost periphery of the bit body 2 at equal intervals along the circumferential direction, 4 holes are also formed in the innermost periphery of the bit body 2 at equal intervals along the circumferential direction, and 3 holes are formed in the middle of said outermost periphery and innermost periphery at equal intervals along the circumferential direction. As a result, the cutting elements are not radially aligned and the cutting ends are located along a zig-zag path on each block.

In each hole 8 is fixed a thin stick-shaped cutting element or chip 9 made of cemented tungstencarbide by planting its base therein. The lengthwise substantial portion of the respective chips 9 projects from the fore end face of the bit body 2 along the axial direction of the bit body 2 by a practically uniform length. The shape of the section of each chip 9 can be circular, but the one illustrated in FIG. 2 is almost semicircular having a diameter of less than 5 millimeters, preferably in the range of from 1 to 3 millimeters, and its linear portion is disposed at the rear in relation to the direction of rotation of the bit body 2. The chips 9 of every block are surrounded en bloc by the matrix 10 which is soft and inferior in abrasion resistance relative to the chips, and the chips 9 and matrix 10 are consolidated to form a tooth 3. Accordingly, in FIG. 2, there are formed three teeth 3. Every tooth 3 is desirably of a construction wherein the top face of the chip 9 and the surface of the matrix 10 form a flat plane so as to have the top face of the tooth 3 composed of a compound surface consisting of the top faces of the chips 9 and the surface of the matrix. However, it also will do to be of construction wherein the top face of the chip 9 substantially projects a little from the surface of the matrix 10 as will be described later on. The outside portion of every chip 9 disposed in the outermost periphery of each tooth 3 projects from the matrix 10 to the extent not exceeding about $\frac{1}{3}$ of the diameter of the chip 9 and this projecting portion is subjected to the grind-finishing and forming a gauge face.

As regard the number of the chips 9 and the density thereof in the arrangement, in the case where the rock, soil, etc. of the object ground are of relatively hard formation, the chips should be relatively densely planted, whereas in the case where they are of relatively soft formation, the chips can be relatively coarsely planted. A very simple means for surrounding the chips 9 by the matrix 10 and consolidating them is to fix the matrix 10 together with the chips 9 onto the top face of the bit body 2 by the use of a welding rod consisting of a material suited for the matrix 10. This method has admittedly a disadvantage that it cannot afford too much length of the tooth, but it is very simple and can be employed for the manufacture of metal crown bit, etc. Further, when the casting method or the powder metallurgy employing a mould or a press die having such dimensions and configurations as will include the chips 9 and fit on the bit body is adopted in lieu of the foregoing method, not only mass production is feasible, but also the length of the tooth 3 can be sufficiently elongated, whereby the life of the tooth can be further prolonged. As the material for the matrix 10, alloys produced by employing some metals selected from nickel, copper, silver, zinc, etc. are applicable, and the hardness thereof is preferably about 100 to 200 in terms of Brinell hardness. And, when there is a fear of intense abrasion of the flank of the matrix 10 due to the circulating fluid arrising from the drilling work, or a proper control of the degree of abrasion of the matrix 10 is aimed at, a powder of tungstencarbide can be mixed in the matrix 10.

When the drilling work is performed by equipping a core bit 1 having a construction as above on a drill pipe, cores enter the hollow part 4 of the bit with the progress of the drilling work, and the circulating fluid for use in drilling flows along the groove 7 provided on the inner wall of the bit body 2, passes through the passage in between the respective teeth 3, goes through the opening between the groove 6 formed on the outer wall of the bit body 2 and the wall of the hole formed by the drilling work, and ascends through the interstice between the outer periphery of the drill pipe and the wall of the hole. On this occasion, the cuttings are discharged to the surface of the ground by means of the circulating mud.

Figure 3:
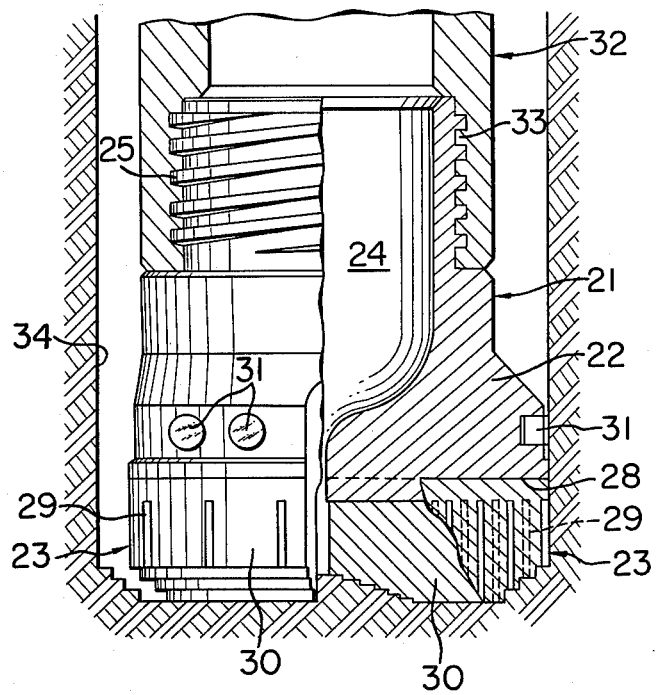
FIG. 3 is a longitudinal sectional view, partly broken away, of a second embodiment of the rotary abrasive drilling bit according to the present invention, wherein the ground is also illustrated to afford a better understanding of the mode of use of the bit.
Figure 4:
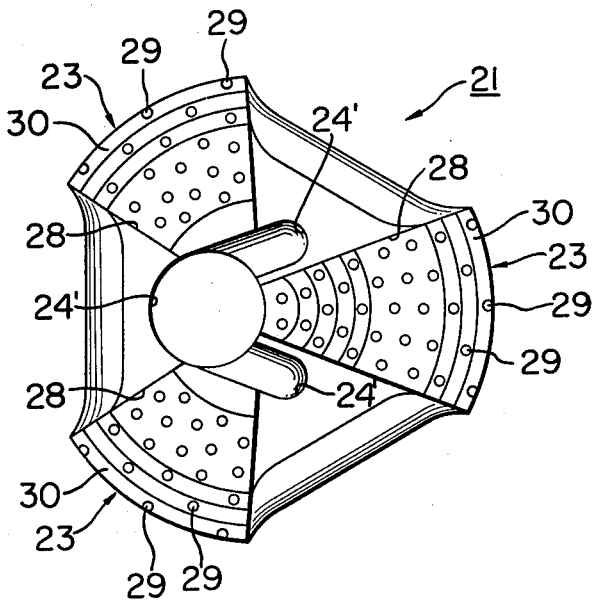
FIG. 4 is a plan view of the end surface of the rotary abrasive drilling bit illustrated in FIG. 3.
Figure 5A:
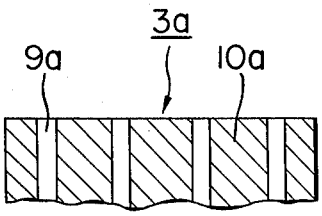
FIGS. 5(*a*) through 5(*d*) are respectively an enlarged sectional view of the essential part of various examples of the tooth of the rotary abrasive drilling bit according to the present invention, which is illustrative of the initial condition of the respective teeth before use.
Figure 5B:
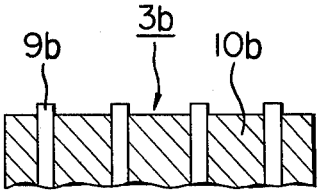
Figure 5C:
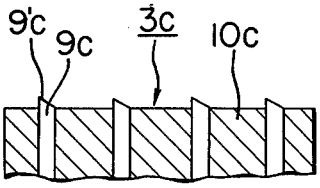
Figure 5D:
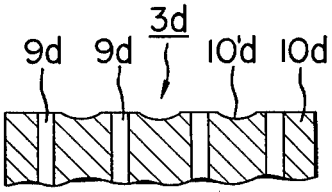

Shown in FIGS. 3 and 4 is a second embodiment of the rotary abrasive drilling bit according to the present invention. This is of the so-called noncore bit type wherein the tooth is independently constructed by the casting method or the powder metallurgy and is thereafter installed on a bit body.

In FIGS. 3 and 4, the reference numeral 21 denotes a drilling bit built as the noncore bit. 22 denotes a bit body whose inside is provided with a fluid passage 24, the fore end of said passage 24 opening as the fluid nozzle 24', and on the outer periphery of the base thereof is provided a threaded portion 25. 23 denotes a tooth which is composed of a plurality of chips 29, each chip being made of cemented tungstencarbide and shaped in a thin stick, and the matrix 30 surrounding the chips 29, said matrix being of soft and inferior in abrasion resistance relative to said chip. 32 denotes a hollow drill pipe of which the inner periphery of the fore part is provided with a threaded portion 33 to engage with the aforementioned threaded portion 25. 34 denotes the wall of a hole formed as a result of the drilling work performed by this drilling bit 21.

The section of each chip 29 is shaped in a circle having a diameter of less than 5 millimeters, preferably in the range of from 1 to 3 millimeters.

In the fore end portion of the bit body 22 are formed a plurality of grooves 28—in FIGS. 3 and 4, there are provided 3 grooves—which extend radially from the vicinity of the center of the bit body 22 up to the outermost periphery thereof and are uniformly distributed in relation to the circumference of the bit body 22. The teeth 23 respectively fit in these grooves 28 and are fixed by welding. Accordingly, in FIGS. 3 and 4, the number of the teeth 23 equipped on the bit body 22 is three. Each tooth 23 is formed by the casting method or the powder metallurgy employing a mould or a press die which is of a configuration such that, when the resulting tooth is equipped on the bit body 22, each chip 29 extends along the direction of axis of the bit body 22 within the matrix 30 and is disposed at a desired interval from each other along the direction of radius as well as the direction of circumference of the bit body 22, and the cutting face of the tooth 23 is to be composed of a compound surface consisting of the top face of the chip 29 and the surface of the matrix 30. The outside portion of every chip 29 disposed in the outermost periphery of each tooth 23 projects from the matrix 30 to the extent not exceeding about ⅓ of the diameter of the chip 29, and this projecting portion is subjected to the grind-finishing so as to agree with the outermost periphery of the bit body 22, thereby forming a gauge face. Therefore, every tooth 23 is provided with a gauge face, and is suited for the drilling work. However, in the case where the area of the gauge face is still insufficient, it is possible to attach a hard metal 31 having a hardness practically equal to the chip 29 onto the outside face of the bit body 22 and use the surface of the thus-attached metal 31 as the gauge face.

Shown in FIGS. 5(*a*) through 5(*d*) are respectively an initial condition of various examples of the tooth of the rotary abrasive drilling bit according to the present invention before use. In the tooth 3*a* illustrated in FIG. 5(*a*), the top face of the chip 9*a* and the surface of the matrix 10*a* form a flat plane. In the tooth illustrated in FIG. 5(*b*), the top face of the chip 9*b* slightly projects from the surface of the matrix 10*b*. In the tooth 3*c* illustrated in FIG. 5(*c*), the edge 9'*c* formed on the fore end of the chip 9*c* slightly projects from the surface of the matrix 10*c*. And, in the tooth 3*d* illustrated in FIG. 5(*d*), shallow grooves 10'*d* disposed in between the chips 9*d* are formed on the surface of the matrix 10*d*. The teeth 3*b*, 3*c* and 3*d* illustrated in FIGS. 5(*b*) through 5(*d*) are all capable of readily producing cuttings and slime without obstructing generation thereof from the beginning of the use in the drilling work. However, even a tooth, which is not of the foregoing construction but is constructed to have the top face of the chip 9*a* and the surface of the matrix 10*a* formed in a flat plane like the tooth 3*a* illustrated in FIG. 5(*a*), is sufficient for the drilling purpose as it does not substantially obstruct the generation of cuttings, slime, etc. from the beginning of the use thereof. Besides this tooth 3*a* has an advantage that it is easy to manufacture.

Figure 6:
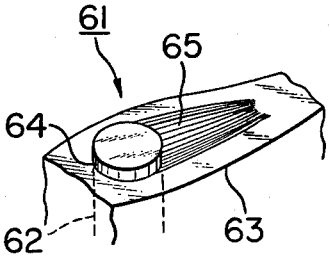
FIG. 6 is an enlarged perspective view of the essential part of an example of the tooth of the rotary abrasive drilling bit according to the present invention, which is illustrative of the condition of the tooth when it is in use for the drilling work.
Figure 7:
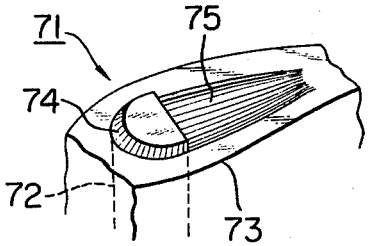
FIG. 7 is an enlarged perspective view of the essential part of another example of the tooth of the rotary abrasive drilling bit according to the present invention, which is illustrative of the condition of the tooth when it is in use for the drilling work.

Shown in FIGS. 6 and 7 are examples of the state of various teeth for the rotary abrasive drilling bit according to the present invention at the time when they are in use for the drilling work.

When a rotary abrasive drilling bit according to the present invention is normally serving for the drilling work, as illustrated in FIG. 6 or 7, the matrix 63 or 73 disposed in front of the chip 62 or 72 wears due to friction with the ground, especially rock, as a result of rotation thereof, whereby the edge portion of the chip 64 or 74 of the chip 62 or 72 comes to project appropriately from the matrix 63 or 73, and at the same time, by dint of the cuttings, slime, etc. pushed away to the back by the circulating mud, the matrix 63 or 73 around the chip 62 or 72 wears while leaving its portion behind the chip 62 or 72 unworn. As a result, there is formed a streamlined projection 65 or 75 behind the chip 62 or 72. This projection 65 or 75 supports the fore end portion of the chip 62 or 72 from behind and protects it so as not to break. Therefore, even when the edge portion 64 or 74 of the chip 62 or 72 considerably projects from the matrix 63 or 73, the fore end portion of the chip 62 or 72 would not break or snap.

As a result of the drilling work, the edge portion 64 or 74 of the chip 62 or 72 wears to become roundish. But, the rotary abrasive drilling bit according to the present invention, as compared with ones in the prior art, is considerably small in diameter as well as sectional area of each chip relative to the size of the bit body, and therefore, even when the edge portion 64 or 74 of each chip 62 or 72 wears as above, the harmful influence of this abrasion on the tooth 61 or 71 as a whole is substantially negligible. Accordingly, there is no substantial lowering of the boring efficiency. Besides, as the abrasion of the edge portion 64 or 74 means a decrease in the resistance of the cutting face of the chip 62 or 72, in the tooth 61 or 71 are to be scattered edges which are not strong in the resistance of the cutting face such as suited for the drilling of a ground of hard formation. Consequently, the foregoing abrasion has no harmful influence on the rotary abrasive drilling bit according to the present invention, but is rather beneficial. Moreover, although the fore end portion of the chip 62 or 72 wears continuously pursuant to the drilling work, inasmuch as the matrix 63 or 73 also wears continuously in keeping with the abrasion of the chip 62 or 72, the edge portion 64 or 74 of the chip 62 or 72 always projects from the matrix 63 or 73 by an appropriate length, and accordingly, the drilling work can be continued until the tooth 61 or 71 is substantially consumed.

In the tooth 61 illustrated in FIG. 6, the sectional shape of the chip 62 thereof is circular, and this tooth is suitable for use in drilling when the object ground, especial rock, is of a relatively soft formation or semi-hard formation. In the case of the tooth 61 as above, however, when the object rock is of a relatively hard formation, the front edge portion of the chip 62 is subjected to a strong abrasive action whereby the drilling speed is held relatively low, whereas the rear edge portion thereof is subjected to a strong cutting resistance whereby damage is caused on said rear edge portion of the chip 62. Therefore, in the case of drilling such a rock of relatively hard formation, as exemplified by the tooth 71 illustrated in FIG. 7, the chip 72 can be configured to have a semicircular section or a similar section of which the rear part is to be linear, thereby making it free from said cutting resistance.

The drilling capability of the tooth of the rotary abrasive drilling bit according to the present invention is derived from the chip made of cemented tungstencarbide, which chip always projects by an appropriate length naturally from the matrix which is of a soft formation and is inferior in abrasion resistance relative to the chip. This phenomenon is mainly attributable to an intense frictional effect which is brought at the time when the cuttings, slime, etc. produced in the course of drilling pass along the cutting face and works on the matrix. In other words, generation of the cutting, slime, etc. constitutes an important factor which indicates the drilling capability of the drilling bit according to the present invention. Accordingly, especially when the object ground is of a relatively hard formation, application of a tooth having a flat plane-shaped cutting face such as illustrated in FIG. 5(*a*) occasionally fails to manifest drilling capability because of the slippery cutting face thereof. In such a case, it is possible to bring a stress differential between the cemented tungstencarbide chip and the matrix of soft formation by increasing the cutting pressure by 20 to 30 percent of the normal load thereof, thereby to effectuate the drilling. However, the intense stress differential on this occasion imparts a strong concentrated reaction force to the cemented tungstencarbide chip at the rear edge portion along the direction of progress thereof, and the concentrated reaction force thus imparted to the chip will not only obstruct the drilling capability of the cemented tungstencarbide chip but also cause it to break when the ground is of a hard formation.

In such a case, as aforementioned with reference to FIG. 7, the chip can be configured to have a semicircular section or a similar section and to dispose the linear portion thereof at the rear in relation to the direction of rotation of the bit body, thereby shifting the neutral point of said concentrated reaction force to the rear of the linear portion of the chip so that the chip can be free from said concentrated reaction force. However, when a tooth in which the fore end of the chip substantially projects from the surface of the matrix such as illustrated in FIGS. 5(*b*) through 5(*d*) is used in place of the aforementioned tooth, the cuttings, slime, etc. can easily be produced from the beginning of the drilling work without increasing the cutting pressure from the normal load thereof as set forth above.

Further, generally speaking, the amount of the cuttings arising from the drilling work is practically proportioned to the softness of the object ground when the conditions for drilling are fixed. Therefore, in the case of drilling a relatively soft ground, there is produced a relatively large quantity of cuttings, whereby abrasion of the matrix is relatively much and the portion of the chip projecting from the matrix is relatively long, while in the case of drilling a relatively hard ground, the portion of the chip projecting from the matrix is relatively short. This means that the length of the chip projecting from the matrix varies with the hardness of the object ground, coupled with the strength of the chip per se. Accordingly, in the case of the tooth of the rotary abrasive drilling bit according to the present invention, a cutting face which is most favorable for the kind of the object ground is formed practically in the initial stage of the drilling work, and thereafter the thus-formed optimum cutting face is maintained for a long time until the tooth is substantially consumed.

Furthermore, the rotary abrasive drilling bit according to the present invention has an advantage that it can continue working stably even when it encounters a change of stratum, a crushed layer, a fault, etc. Besides, the present bit can minimize the use of cemented tungstencarbide, a precious resouce, as a material therefor and consume almost all of it directly as the cutting edge.

Although particular preferred embodiments of the invention have been disclosed in detail for illustrative purpose, it will be recognized that variations or modifications of the above disclosed apparatuses, including the arrangement of parts, lie within the scope of the present invention.

What is claimed is:

1. A rotary abrasive drilling bit comprising a bit body attached to a rotary drill pipe and a plurality of teeth equipped on the fore part of said bit body, wherein each of said teeth is composed of a plurality of tungsten carbide thin sticklike cutting elements and a matrix that is softer than and inferior in abrasion resistance to said elements, all said sticklike tungsten carbide elements extending along the cutting direction of said bit body and orderly arranged in each tooth with a desired space therebetween radially as well as circumferentially of the bit body with the ends located in a zig-zag path transverse to said cutting direction, said matrix surrounding the tungsten carbide thin sticklike elements and maintaining them in the aforesaid arrangement, and the cutting face of said tooth being composed of a compound surface consisting of the end faces of the tungsten carbide thin sticklike elements and the surface of the matrix, whereby when the edges of the tungsten carbide thin sticklike elements are worn down and shortened with the progress of drilling work the surface of the matrix is also worn down to the same extent in concert therewith to maintain the teeth suitable for drilling purposes.

2. A rotary abrasive drilling bit according to claim 1 wherein the shape of the cross section of each tungsten carbide thin sticklike cutting element is substantially semicircular and the linear portion of said semicircular shape is disposed at the rear in relation to the direction of rotation of said bit body to thereby minimize the resistance applied onto the cutting face at exposed ends of the tungsten carbide elements.

3. A rotary abrasive drilling bit according to claim 1 wherein the major cross sectional dimension of each tungsten carbide thin sticklike cutting element is less than 5 millimeters.

4. A rotary abrasive drilling bit according to claim 1 wherein the major cross sectional dimension of each tungsten carbide thin sticklike cutting element is in the range of from 1 to 3 millimeters.

5. A rotary abrasive drilling bit according to claim 1 wherein said matrix consists of an alloy including nickel, copper, silver, or zinc.

* * * * *